US011377996B2

(12) United States Patent
Gleixner et al.

(10) Patent No.: US 11,377,996 B2
(45) Date of Patent: Jul. 5, 2022

(54) MUFFLER WITH BAFFLE DEFINING MULTIPLE CHAMBERS

(71) Applicant: Briggs & Stratton, LLC, Wauwatosa, WI (US)

(72) Inventors: Steve Gleixner, Brookfield, WI (US); Robert Johnson, New Berlin, WI (US); Patrick Crowley, Naperville, IL (US); Brett Birschbach, Wauwatosa, WI (US)

(73) Assignee: Briggs & Stratton, LLC, Wauwatosa, WI (US)

( * ) Notice: Subject to any disclaimer, the term of this patent is extended or adjusted under 35 U.S.C. 154(b) by 243 days.

(21) Appl. No.: 16/619,292

(22) PCT Filed: Jun. 6, 2018

(86) PCT No.: PCT/US2018/036242
§ 371 (c)(1),
(2) Date: Dec. 4, 2019

(87) PCT Pub. No.: WO2018/226818
PCT Pub. Date: Dec. 13, 2018

(65) Prior Publication Data

US 2020/0141301 A1 May 7, 2020

Related U.S. Application Data

(60) Provisional application No. 62/517,362, filed on Jun. 9, 2017.

(51) Int. Cl.
*F01N 1/08* (2006.01)
*F01N 13/10* (2010.01)
(Continued)

(52) U.S. Cl.
CPC ..... *F01N 13/1838* (2013.01); *F01N 1/083* (2013.01)

(58) Field of Classification Search
CPC . F01N 1/083; F01N 1/08; F01N 1/082; F01N 1/089; F01N 1/10; F01N 13/1838;
(Continued)

(56) References Cited

U.S. PATENT DOCUMENTS 2,919,761 A * 1/1960 Smith ..... F01N 1/083 181/272
2,975,854 A * 3/1961 Bakke ..... F01N 13/1805 181/239
(Continued)

FOREIGN PATENT DOCUMENTS

CN 102297044 A 12/2011
CN 105422217 A * 3/2016
(Continued)

OTHER PUBLICATIONS

International Search Report and Written Opinion, PCT/US2018/036242, Briggs & Stratton Corporation (dated Aug. 27, 2018).

*Primary Examiner* — Edgardo San Martin
(74) *Attorney, Agent, or Firm* — Foley & Lardner LLP

(57) ABSTRACT

An internal combustion engine includes an engine block including a cylinder and a muffler assembly configured to receive exhaust gases from the cylinder. The muffler assembly includes a housing defining an interior volume and including an exhaust inlet and an exhaust outlet, and a baffle assembly positioned within the interior volume. The baffle assembly includes a plurality of chambers in fluid communication with each other. The plurality of chambers are in fluid communication with the exhaust inlet and the exhaust outlet so that the plurality of chambers are configured to cause exhaust gases to be directed through the muffler assembly from the exhaust inlet to the exhaust outlet through four passes in the baffle assembly before exiting through the exhaust outlet.

14 Claims, 10 Drawing Sheets

(51) Int. Cl.
*F01N 13/18* (2010.01)
*F01N 1/00* (2006.01)
*F01N 13/08* (2010.01)

(58) Field of Classification Search
CPC .... F01N 13/002; F01N 13/10; F01N 13/1888; F01N 13/1877; F01N 2490/08; F01N 2490/15; F01N 2490/155
See application file for complete search history.

(56) References Cited

U.S. PATENT DOCUMENTS 3,381,774 A * 5/1968 Stade ..... F01N 1/083 181/272
3,650,354 A 3/1972 Gordon
3,685,613 A * 8/1972 Snodgrass ..... F01N 13/1888 181/204
3,863,734 A * 2/1975 Pawlina ..... F01N 13/185 181/264
3,968,854 A 7/1976 Gordon et al.
4,142,607 A * 3/1979 Landwehr ..... F01N 1/084 181/229
4,164,989 A * 8/1979 Lux ..... F01N 1/08 181/259
4,165,798 A * 8/1979 Martinez ..... F01N 1/06 181/206
4,628,689 A 12/1986 Jourdan
4,854,417 A * 8/1989 Uesugi ..... F01N 1/089 181/272
5,183,977 A 2/1993 Horitani
5,206,467 A * 4/1993 Nagai ..... F01N 1/10 181/232
5,949,035 A * 9/1999 Herold ..... F01N 1/08 181/282
6,076,632 A * 6/2000 Schuhmacher ..... F01N 1/06 181/272
6,109,026 A * 8/2000 Karlsson ..... F01N 1/083 181/213
6,250,422 B1 6/2001 Goplen et al.
6,457,553 B1 10/2002 Goplen et al.
7,032,709 B2 * 4/2006 Hoche ..... F01N 1/02 181/268
7,296,657 B2 * 11/2007 Ohno ..... F01N 1/089 181/272
7,389,853 B2 * 6/2008 Ryczek ..... F01N 1/08 181/272
7,527,774 B2 * 5/2009 Galligan ..... F01N 1/081 181/212
7,854,296 B2 * 12/2010 Saunders ..... F01N 13/082 181/240
7,896,127 B2 * 3/2011 Sato ..... F01N 13/1805 181/240
8,495,995 B2 7/2013 Drew et al.
8,844,276 B2 * 9/2014 Kawase ..... F01N 13/1855 60/320
9,046,028 B2 * 6/2015 Yasoshina ..... F01N 13/08
2005/0217931 A1 10/2005 Assad
2007/0144828 A1 6/2007 Galligan
2009/0038879 A1 2/2009 Sato et al.
2009/0293462 A1 * 12/2009 Duch ..... F01N 1/083 60/299
2020/0386132 A1 * 12/2020 Greif ..... F01N 1/02

FOREIGN PATENT DOCUMENTS

CN 105464754 A * 4/2016
CN 110469384 A * 11/2019
CN 112049710 A * 12/2020 ..... G10K 11/161
EP 1895118 A1 * 3/2008 ..... F01N 3/34
RU 177871 U1 * 3/2018

* cited by examiner

MUFFLER WITH BAFFLE DEFINING MULTIPLE CHAMBERS

CROSS-REFERENCE TO RELATED PATENT APPLICATIONS

This application is a National Stage Application of PCT/US2018/036242, filed Jun. 6, 2018, which claims the benefit of and priority to U.S. Provisional Application No. 62/517,362, filed Jun. 9, 2017, both of which are incorporated herein by reference in their entireties.

BACKGROUND

The present application generally relates to the field of mufflers, such as those for use with internal combustion engines.

SUMMARY

One embodiment relates to an internal combustion engine. The engine includes an engine block including a cylinder, and a muffler assembly configured to receive exhaust gases from the cylinder. The muffler assembly includes a housing defining an interior volume and including an exhaust inlet and an exhaust outlet, and a baffle assembly positioned within the interior volume. The baffle assembly includes a plurality of chambers in fluid communication with each other. The plurality of chambers are in fluid communication with the exhaust inlet and the exhaust outlet so that the plurality of chambers are configured to cause exhaust gases to be directed through the muffler assembly from the exhaust inlet to the exhaust outlet through four passes in the baffle assembly before exiting through the exhaust outlet.

Another embodiment relates to a muffler assembly configured to dampen noise of exhaust gases flowing therethrough. The muffler assembly includes a housing defining an interior volume and including an exhaust inlet and an exhaust outlet, and a baffle assembly positioned within the interior volume. The baffle assembly includes multiple chambers in fluid communication with each other. The multiple chambers are in fluid communication with the exhaust inlet and the exhaust outlet so that the multiple chambers are configured to cause exhaust gases to be directed through the muffler assembly from the exhaust inlet to the exhaust outlet through four passes in the baffle assembly before exiting through the exhaust outlet.

Alternative exemplary embodiments relate to other features and combinations of features as may be generally recited in the claims.

BRIEF DESCRIPTION OF THE FIGURES

The disclosure will become more fully understood from the following detailed description, taken in conjunction with the accompanying figures, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
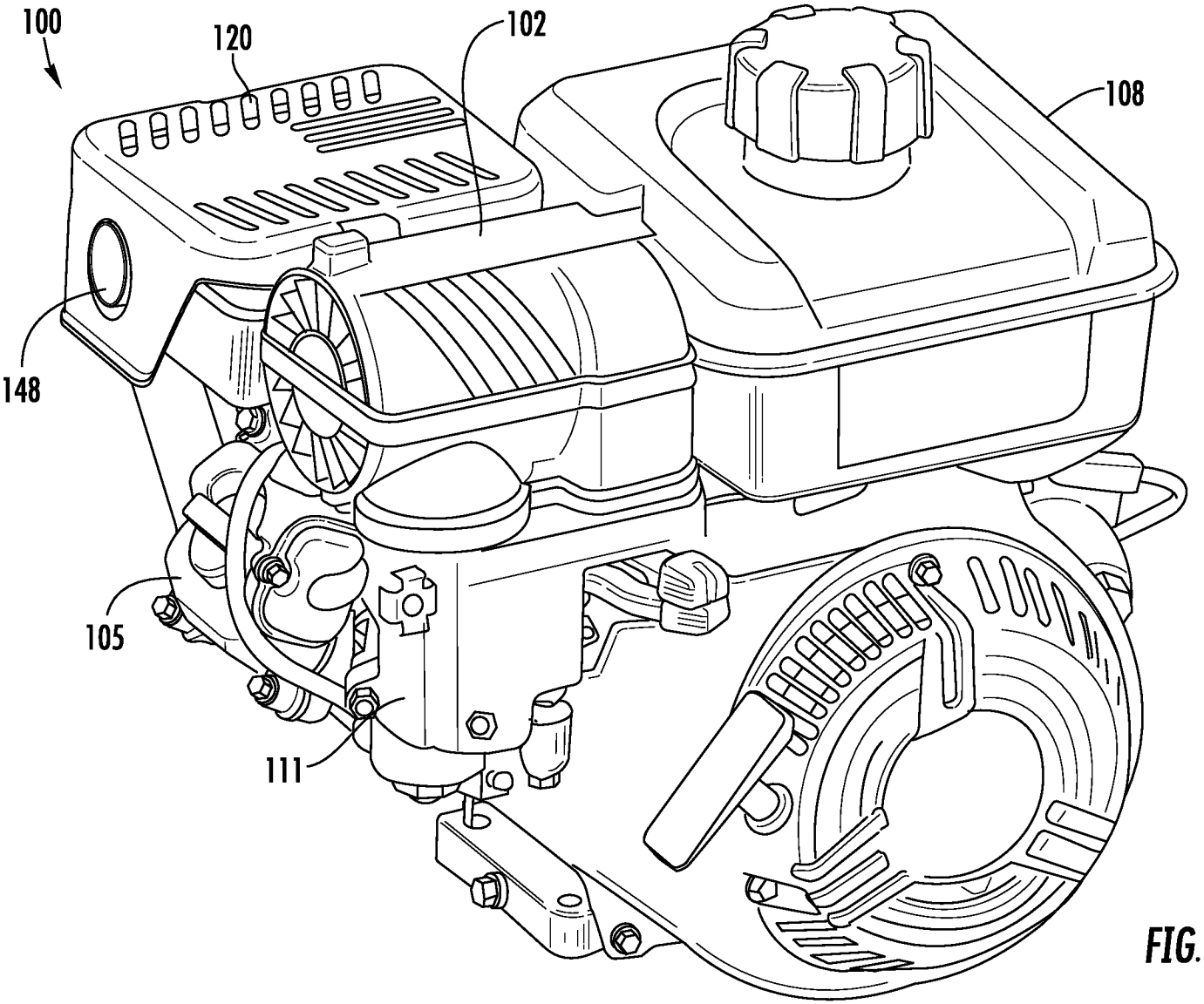
FIG. 1 is a front perspective view of an internal combustion engine, according to an exemplary embodiment.
Figure 2:
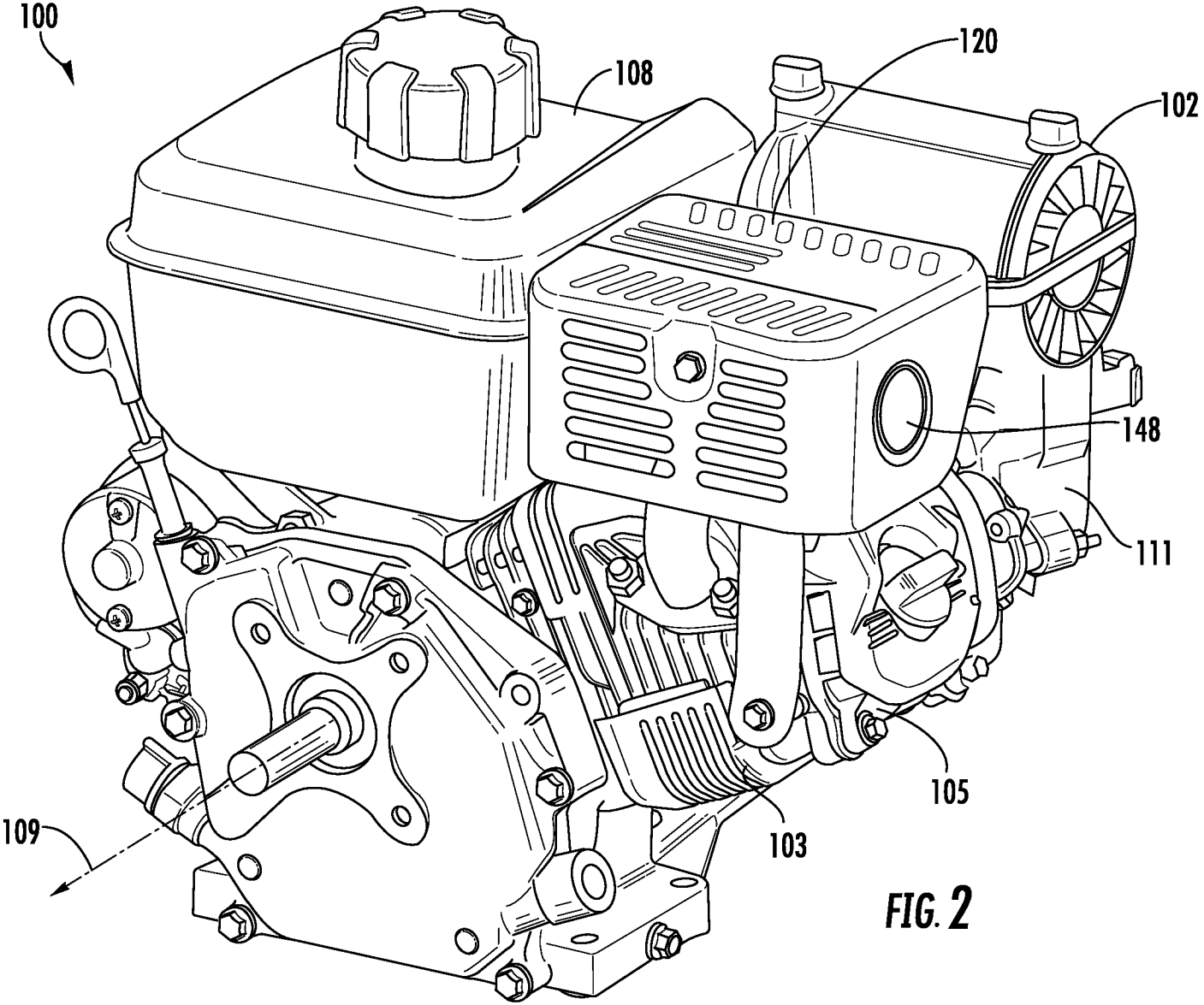
FIG. 2 is a rear perspective view of the internal combustion engine of FIG. 1.

Referring to FIGS. 1-2, an internal combustion engine 100 is illustrated according to an exemplary embodiment. The internal combustion engine 100 includes an engine block 101 having one or more cylinders 103, cylinder heads 105, and pistons, and a crankshaft 107. Each piston reciprocates in a cylinder 103 along a cylinder axis to drive the crankshaft 107. The crankshaft 107 rotates about a crankshaft axis 109. The crankshaft 107 is positioned in part within a crankcase 113. In an exemplary embodiment, the crankshaft 107 may be oriented horizontally (i.e., a horizontal engine) with the engine 100 in its normal operating position. In other embodiments, the crankshaft 107 is vertically oriented (i.e., a vertical engine) with the engine 100 in its normal operating position. The engine may include one cylinder or two or more cylinders. The engine 100 also includes an air-fuel mixing device 111 for supplying an air-fuel mixture to the cylinder (e.g., a carburetor, an electronic fuel injection system, a fuel direct injection system, etc.), a fuel tank 108, an air filter assembly 102, and a muffler assembly 120.

The engine 100 can be used on a variety of end products, including outdoor power equipment, portable jobsite equipment, and standby or portable generators. Outdoor power equipment includes lawn mowers, riding tractors, snow throwers, pressure washers, tillers, log splitters, zero-turn radius mowers, walk-behind mowers, riding mowers, stand-on mowers, pavement surface preparation devices, industrial vehicles such as forklifts, utility vehicles, commercial turf equipment such as blowers, vacuums, debris loaders, overseeders, power rakes, aerators, sod cutters, brush mowers, etc. Outdoor power equipment may, for example, use the engine 100 to drive an implement, such as a rotary blade of a lawn mower, a pump of a pressure washer, an auger of a snow thrower, and/or a drivetrain of the outdoor power equipment. Portable jobsite equipment includes portable light towers, mobile industrial heaters, and portable light stands.

Referring to FIGS. 1-10, the engine 100 includes a muffler assembly 120 according to an exemplary embodiment. The muffler assembly 120 includes an exhaust conduit 122 that is fastened (e.g., bolted) directly to the cylinder 103 or cylinder head 105 to receive exhaust gases from the cylinder 103 of the engine 100. The muffler assembly 120 may include support structures (e.g., brackets) bolted to the cylinder 103 or otherwise on the engine 100. The muffler assembly 120 is configured to reduce the noise emitted from exhaust gases exiting the cylinder 103 of the engine 100 after the combustion process. With the use of a baffle assembly 140, the muffler assembly 120 is configured to provide four passes of sound filtering to the exhaust gases exiting the engine 100 via the muffler assembly 120, as described further herein.

Figure 7:
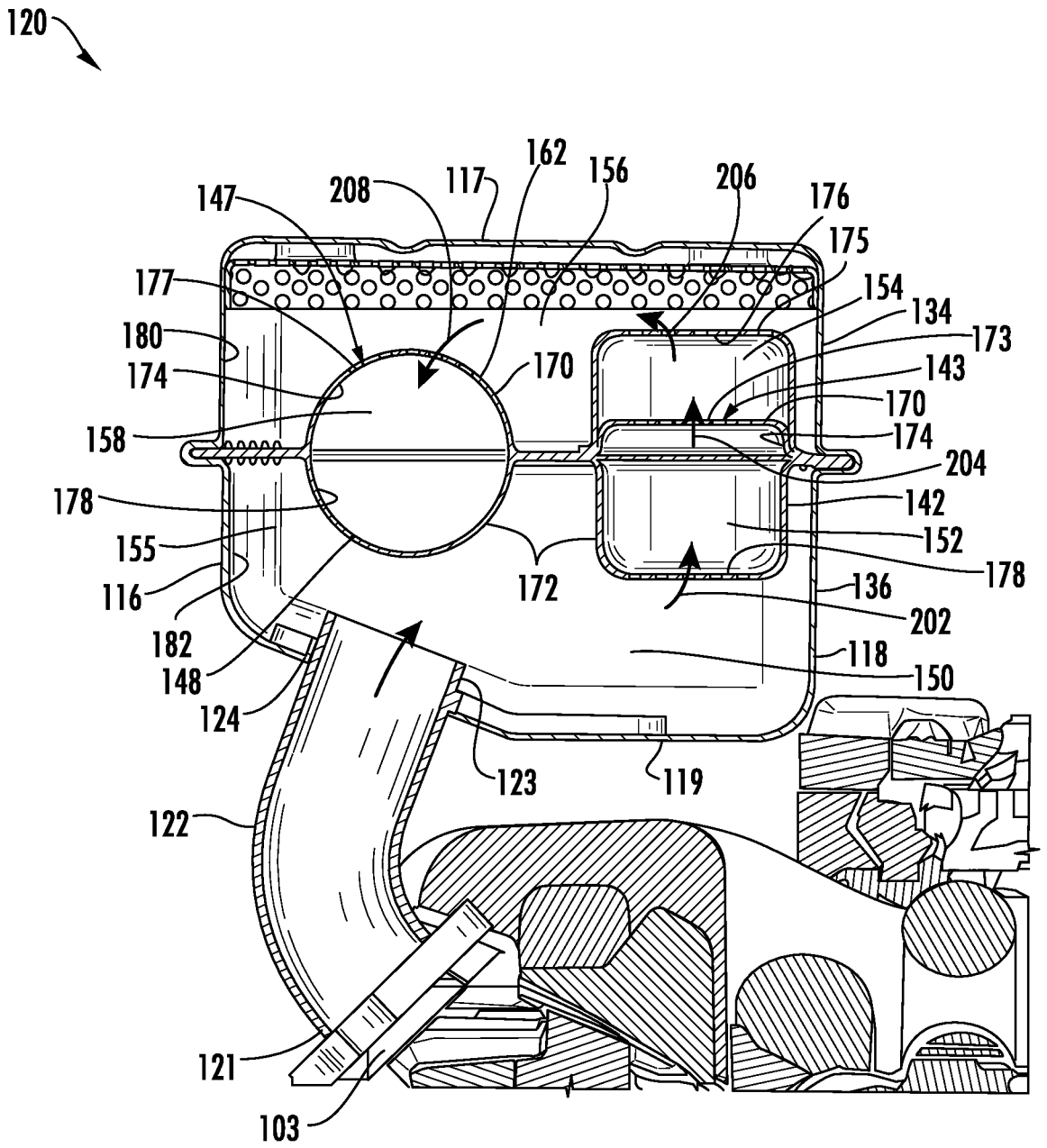
FIG. 7 is a section view of the muffler assembly of FIG. 3 along section line 7-7.
Figure 8:
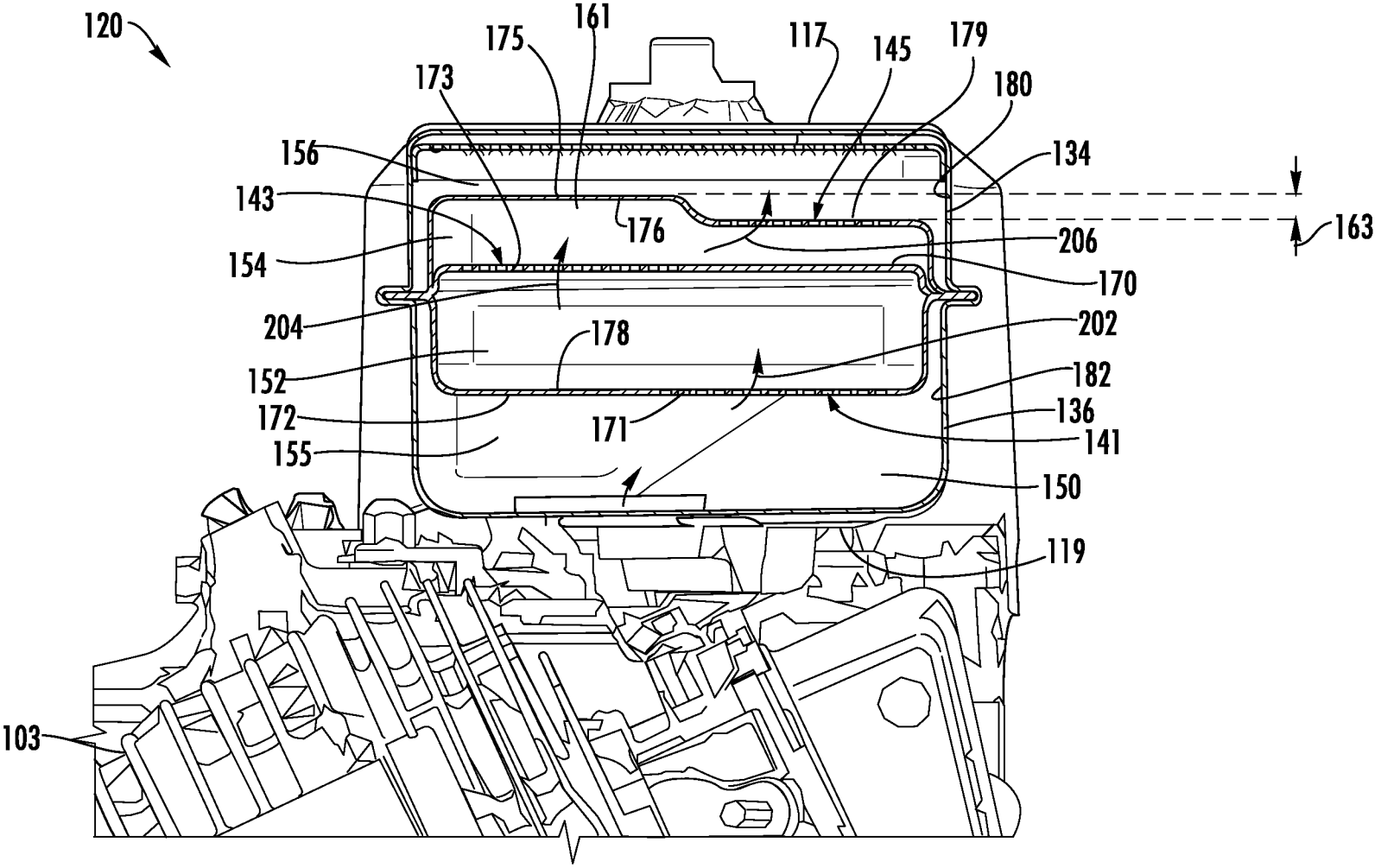
FIG. 8 is a section view of the muffler assembly of FIG. 3 along section line 8-8.

The muffler assembly 120 includes a housing 132 formed by a cover 134 and a base 136. The housing 132 includes a front 112, a rear 114, a left side 116, a right side 118, a top 117, and a bottom 119. As shown in FIGS. 7-8, the interior surface 180 of the cover 134 and the interior surface 182 of the base 136 combine to define an interior volume 155 of the muffler assembly 120, with the interior surface 180 of the cover 134 at least partially defining the interior volume 155 and the interior surface 182 of the base 136 also at least partially defining the interior volume 155. The exhaust conduit 122 is attached to the cylinder 103 at a cylinder end 121 and extends into the muffler housing 132 at a muffler end 123. The muffler end 123 is received within the muffler housing 132 and extends through an exhaust opening 124 formed within the base 136 on the bottom 119 of the housing 132. Accordingly, the exhaust conduit 122 is in fluid communication with the interior volume 155 of the housing 132. After exiting the cylinder 103, the exhaust gases flow through the exhaust conduit 122, from the cylinder end 121 to the muffler end 123, and into the internal volume 155 of the muffler assembly 120.

Figure 3:
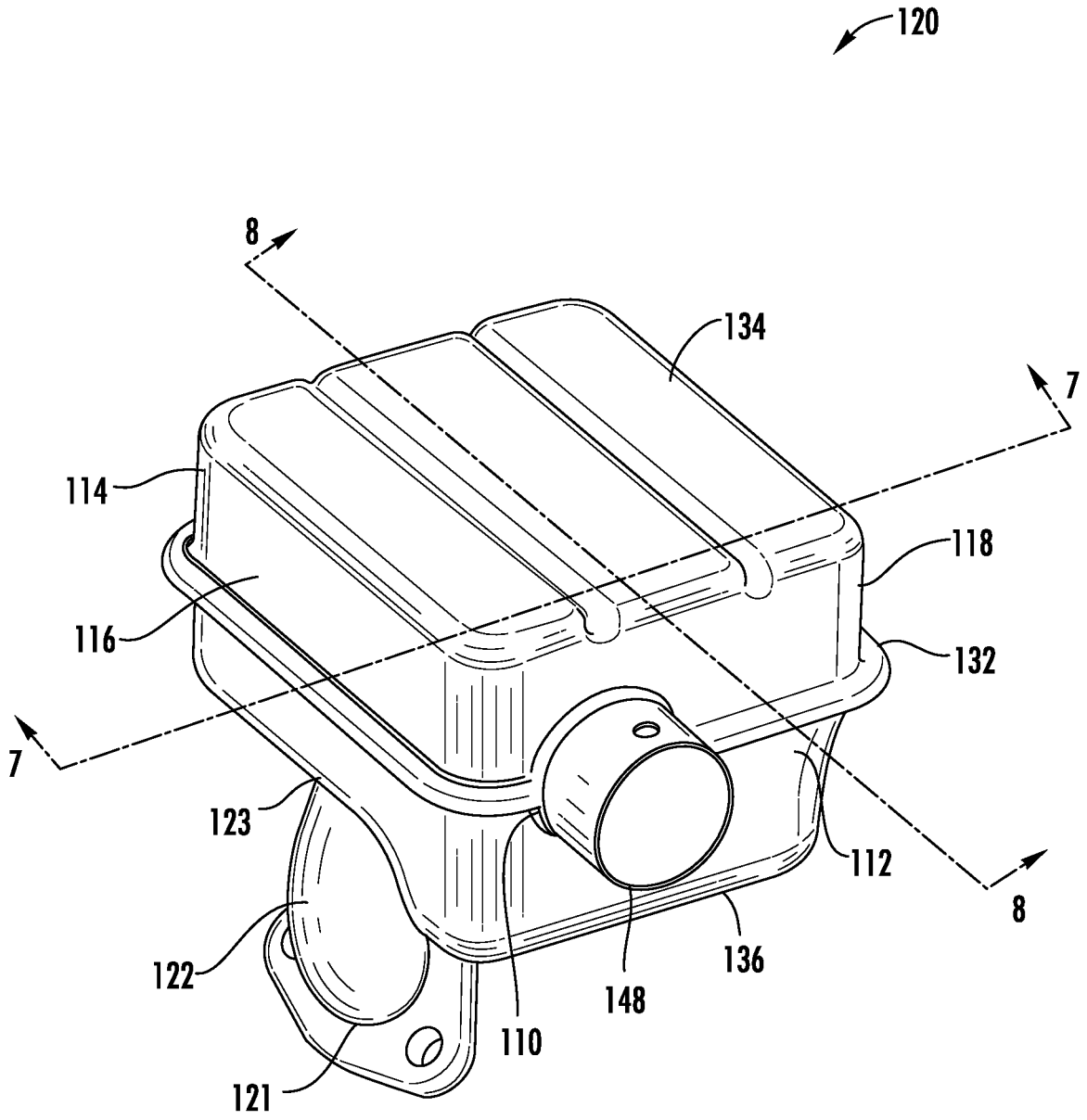
FIG. 3 is a perspective view of a muffler assembly of the engine of FIG. 1.
Figure 4:
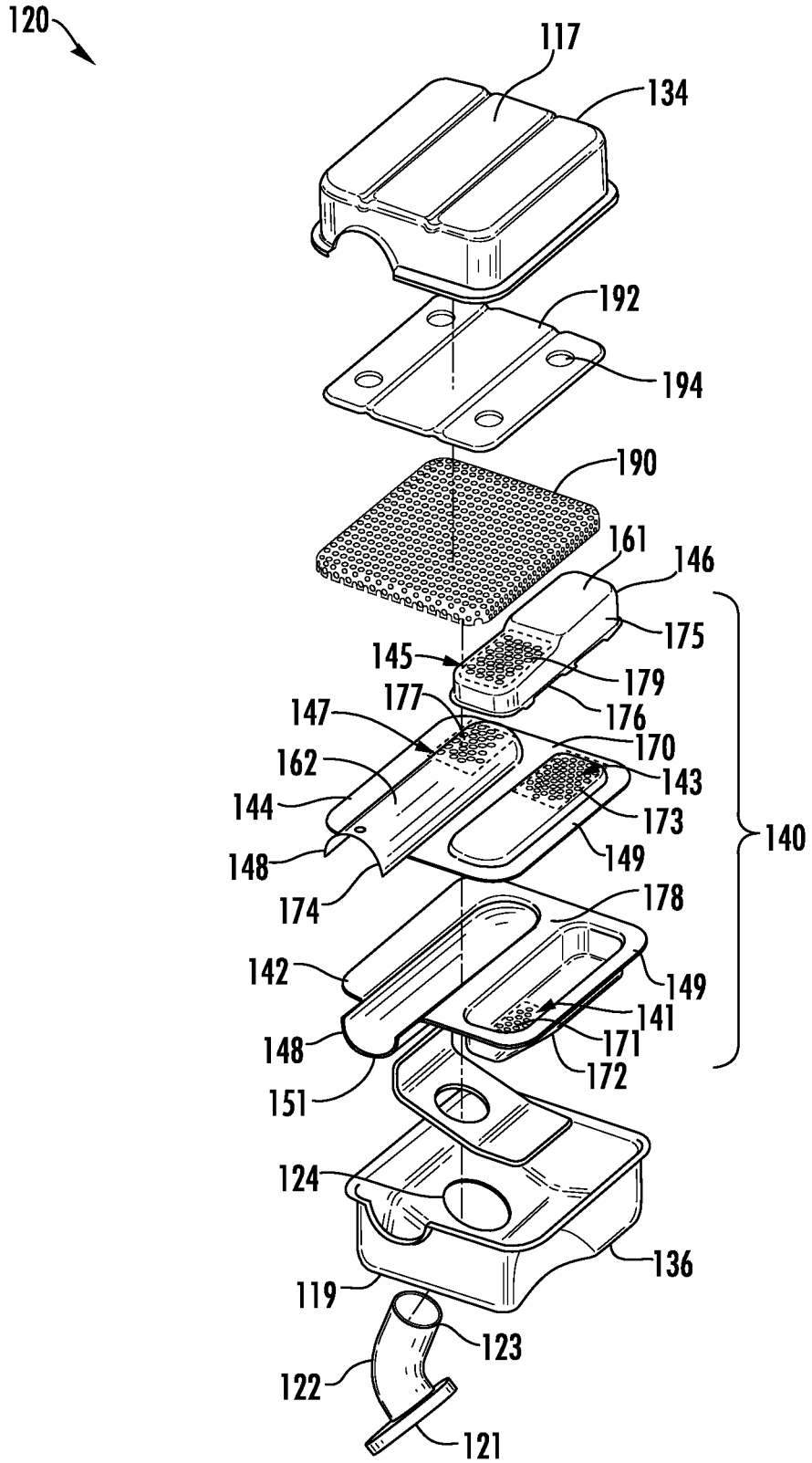
FIG. 4 is an exploded view of the muffler assembly of FIG. 3.

As shown in FIGS. 3-4, the base 136 includes a mounting flange 137 that is arranged to align with and contact a corresponding mounting flange 135 of the cover 134 when the cover 134 is attached to the base 136. The mounting flanges 135, 137 extend around a circumference of the base 136 and cover 134, respectively. The mounting flanges 135, 137 may include a recessed channel 139 that receives a gasket (not shown) to form a seal between the mounting flanges 135 and 137 of the base 136 and the cover 134.

Referring to FIGS. 4-8, the muffler assembly 120 includes a baffle assembly 140 including one or more internal separators (e.g., baffles). The baffle assembly 140 is positioned within the housing 132 of the muffler assembly 120. As shown in FIG. 4, the baffle assembly 140 includes a bottom portion 142, a top portion 144, and a stepped chamber portion 146. In other embodiments, one or more of the portions may be formed as a single integral piece. The baffle assembly 140 includes flange portions 149 formed on the bottom and top portions 142, 144 which are configured to fit between the mounting flanges 135, 137 of the cover 134 and base 136 during assembly of the baffle assembly 140 with the muffler assembly 120. In other embodiments, the baffle assembly 140 is otherwise assembled into the housing 132. The flange portions 149 provide separation of the chambers (e.g., first chamber 150, second chamber 152, third chamber 154, fourth chamber 156, outlet chamber 158) formed within the baffle assembly 140 and within the interior volume 155 of the housing 132. The bottom portion 142 includes an interior surface 178 and an outer surface 172, the top portion 144 includes an interior surface 174 and an outer surface 170, and the stepped chamber portion 146 includes an interior surface 176 and an outer surface 175. The stepped chamber portion 146 includes a stepped (e.g., raised) portion 161 that is a distance 163 higher (FIG. 8) than the rest of the top side of the stepped chamber portion 146. The bottom portion 142 mates with the top portion 144 of the baffle assembly 140 at interior surfaces 178 and 176, respectively, and the interior surface 176 of the stepped chamber portion 146 mates with the outer surface 170 of the top portion 144 to form the baffle assembly 140.

Referring to FIGS. 7-8, when assembled into the muffler housing 132, the baffle assembly 140 divides the internal volume 155 into multiple internal chambers through which exhaust gases flow upon exiting the cylinder 103. With the baffle assembly 140 inserted into (e.g., assembled with) the housing 132, at least five separate chambers are formed. The five chambers within the internal volume 155 are in fluid communication with each other and the exhaust conduit 122. The first chamber 150 (FIG. 7) is formed by the interior surface 182 of the base 136 and the outer surface 172 of the bottom portion 142. The first chamber 150 is positioned proximate the bottom 119 of the housing 132 and the exhaust conduit 122 and extends between the left and right sides 116, 118. The interior surface 178 of the bottom portion 142 and the interior surface 174 of the top portion 144 of the baffle assembly 140 form two separate chambers, a second chamber 152 and an outlet chamber 158 (FIG. 7). In the illustrated embodiments, the second chamber 152 is formed in a rounded rectangular shape (FIG. 8), while the outlet chamber 158 is formed in a rounded tubular shape (FIG. 7), as described further herein. The second chamber 152 is positioned proximate the right side 118 of the housing 132 and runs approximately from the front 112 to the rear 114 of the housing 132 (FIG. 8). The outlet chamber 158 also extends from proximate the front 112 to the rear 114 of the housing 132, but is positioned opposite the second chamber 152 near the left side 116 (FIG. 7). The outlet chamber 158 and second chamber 152 are substantially parallel to each other (FIG. 7). In other embodiments, the chambers 152, 158 can be angled relative to each other.

A third chamber 154 (e.g., stepped chamber 154) is formed by the outer surface 170 of the top portion 144 and the interior surface 176 of the stepped chamber portion 146 (FIG. 8). The third chamber 154 is positioned directly above the second chamber 152 (FIGS. 7-8). A fourth chamber 156 is formed by the outer surface 175 of the stepped chamber portion 146 and an interior surface 180 of the cover 134. The fourth chamber 156 is positioned directly above both of the third chamber 154 and the outlet chamber 158 (FIG. 7). As such, the fourth chamber 156 is positioned proximate the top 117 of the housing 132 and extends between the left and right sides 116, 118 (FIG. 7).

Figure 5:
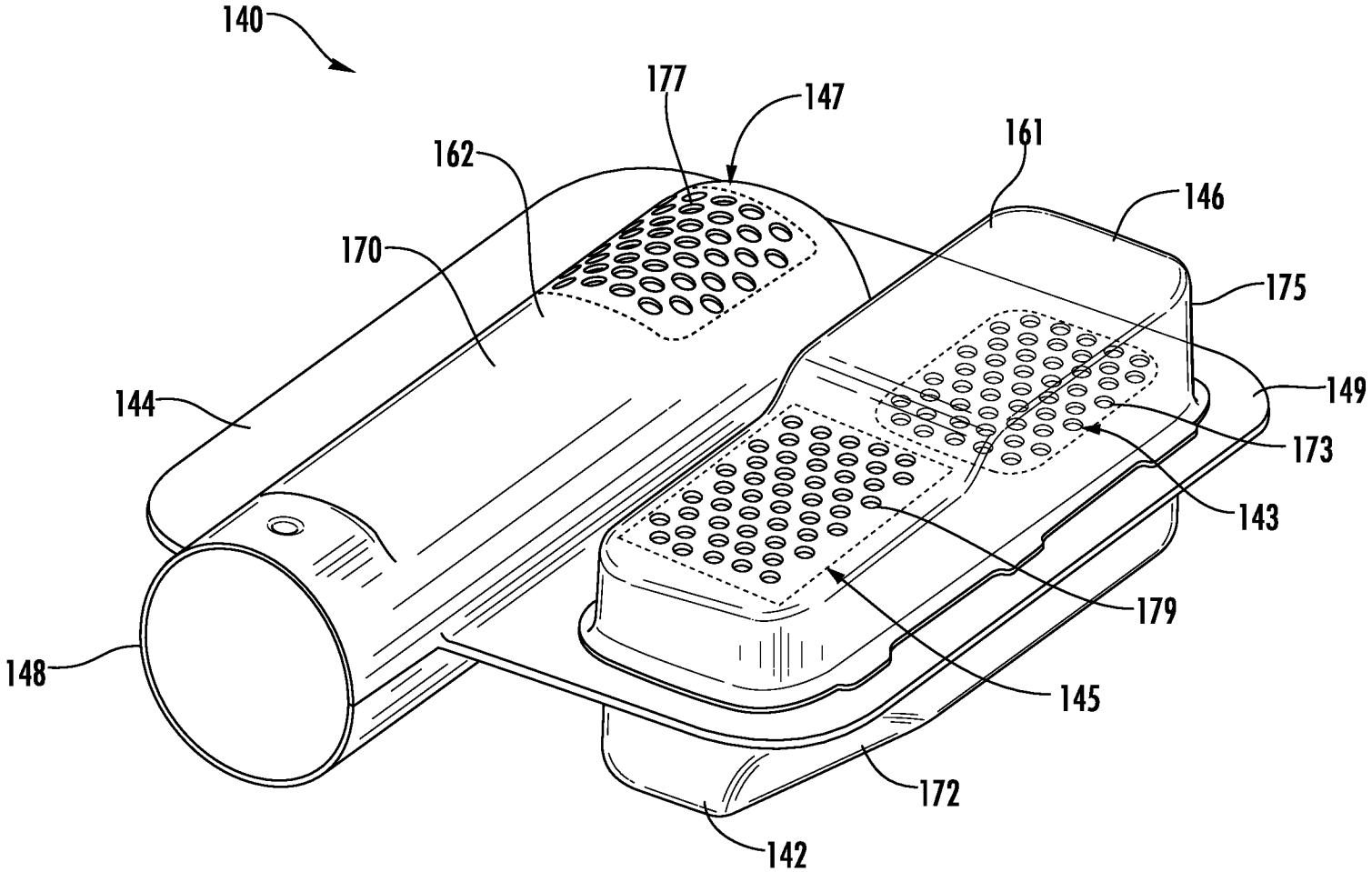
FIG. 5 is a front perspective view of a baffle assembly of the muffler assembly of FIG. 3.
Figure 6:
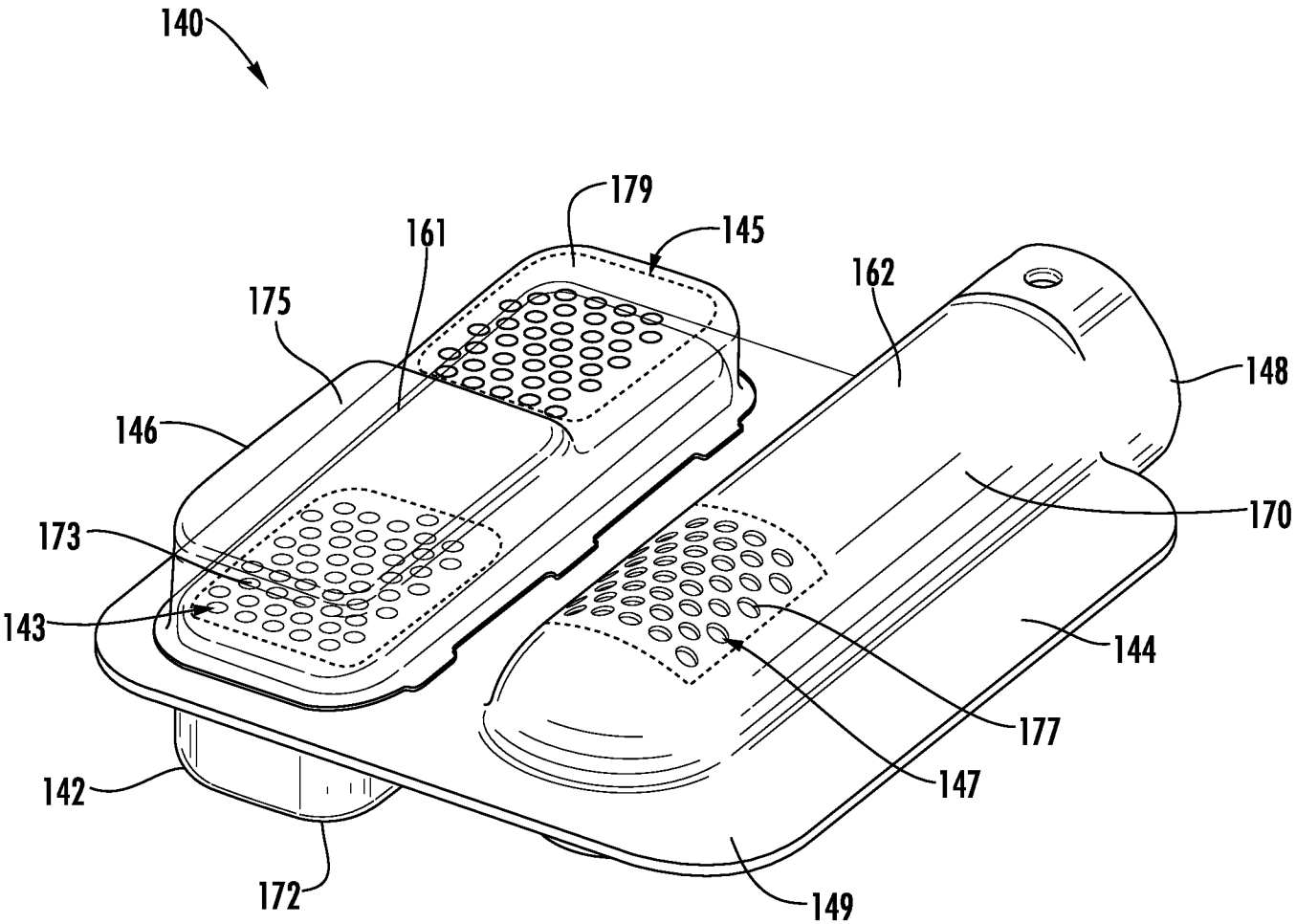
FIG. 6 is a rear perspective view of the baffle assembly of FIG. 5.

Referring to FIG. 7, an outlet tube 148 defines the outlet chamber 158 through which the exhaust gases ultimately exit after flowing through the muffler assembly 120. The outlet tube 148 extends from proximate the rear 114 of the housing 132 through the front 112 of the housing 132 to an end 151 positioned outside the housing 132. In other embodiments, the outlet tube 148 can be otherwise positioned (e.g., extending through rear 114 of the housing 132). The cover 134 and base 136 of the housing 132 form an outlet opening 110 through which the outlet tube 148 partially extends. According to an exemplary embodiment, the outlet tube 148 is circular in cross-section. Accordingly, each of the top portion 144 and bottom portion 142 include semi-circular pieces which mate together to form the tubular shape of the outlet tube 148 and outlet chamber 158. The circular cross-section of the outlet tube 148 facilitates noise reduction in the muffler assembly 120. For example, the overall sound pressure level, which indicates how high the noise levels are at a specific location, is reduced by using the tubular (e.g., rounded surface) outlet structure as shown in FIGS. 5-6 in place of a more rectangular or flat surface outlet structure. In other embodiments, the outlet tube 148 can be oval, oblong, or other curve shapes in cross-section such that the outlet tube 148 has a curved surface (e.g., curved surfaces 162 shown in FIGS. 5-7).

The baffle assembly 140 includes multiple perforated areas including multiple perforations (e.g., apertures). As described further herein, the exhaust gases entering the muffler assembly 120 move through chambers formed by the bottom, top, and stepped chamber portions 142, 144, 146 via the various perforations formed in the baffle assembly 140 and exit the muffler assembly 120 through the outlet tube 148. The bottom portion 142 of the baffle assembly 140 includes a first perforated area 141 including first perforations 171 extending from the first chamber 150 to the second chamber 152. The first perforated area 141 is positioned proximate the front 112 and the right side 118 of the housing 132. The top portion 144 includes a second perforated area 143 positioned above and directly opposite the first perforated area 141 within the second chamber 152. Accordingly, the second perforated area 143 is positioned proximate the rear 114 and the right side 118 of the housing 132. The second perforated area 143 includes second perforations 173 extending between the second chamber 152 and the third chamber 154 (e.g., stepped chamber). The stepped chamber portion 146 includes a third perforated area 145 positioned directly opposite the second perforated area 143 within the third chamber 154 (e.g., stepped chamber). As such, the third perforated area 145 is positioned proximate the front 112 and the right side 118 of the housing 132. The stepped portion 161 of the stepped chamber portion 146 does not include any perforations. The third perforated area 145 includes third perforations 179 extending between the third chamber 154 and the fourth chamber 156. The positioning of the stepped portion 161 relative to the third perforated area 145 provides for a longer and more difficult flow path for the fluid moving through the third chamber 154, and thus, increases noise dampening in that chamber 154. As shown in FIGS. 7-8, all of the first, second, and third perforations 171, 173, and 179 are substantially perpendicular to the surfaces through which the perforations extend. In other embodiments, the first, second, and third perforations 171, 173, and 179 may extend through the surfaces at another angle.

The fourth (e.g., final) perforated area 147 is positioned on the outlet tube 148 of the top portion 144 and includes fourth perforations 177 extending between the fourth chamber 156 and the outlet chamber 158. The fourth perforated area 147 is positioned proximate the rear 114 of the housing 132 near the left side 116. This positioning of the fourth perforated area 147 (e.g., opposite side from the end 151 of the outlet tube 148) of the housing 132 provides as much length (e.g., flow path length) as possible between the fourth perforated area 147 and the end 151 of the outlet tube 148, which is located opposite the fourth perforated area 147 on the front 112 of the housing 132. Providing the longest possible flow path between the fourth perforated area 147 and the end 151 of the outlet tube 148 facilitates dampening of the engine noise prior to the exhaust gases exiting the muffler assembly 120. Furthermore, the fourth perforated area 147 is the only perforated area positioned proximate the left side 116 of the housing 132, while the three other perforated areas (e.g., first, second, and third areas 141, 143, 145) are positioned opposite the fourth perforated area 147 proximate the right side 118. This relative positioning further facilitates optimal noise dampening through the muffler assembly 120.

The fourth perforated area 147 is formed on a curved surface 162 of the outlet tube 148. Accordingly, at least a portion of the fourth perforations 177 are formed such that fluid that flows through the perforations 177 on the outlet tube 148 is coming in at various angles relative to the curved surface 162 of the outlet tube 148. The various angles of fluid flow into the outlet chamber 158 results in optimized mixing of the fluid moving through the outlet chamber 158 (e.g., gases moving toward and mixing with other gases entering the chamber) and as such, results in more attenuation of noise relative to the use of flat surface perforations.

In operation, exhaust gases flow into the exhaust conduit 122 of the muffler assembly 120. The exhaust conduit 122 is fluidly coupled to the interior volume 155 of the housing 132 such that exhaust gases flow into the housing 132 of the muffler assembly 120 for noise dampening. Once inside the housing 132, the exhaust gases move from the exhaust conduit 122 toward the outlet tube 148 via multiple sets of perforations and chambers, thereby reducing the resultant noise of the exhaust gases exiting the engine 100. The incoming exhaust gases complete at least four passes (e.g., travel through at least four perforated areas) through the baffle assembly 140 prior to exiting the muffler assembly 120.

Figure 9:
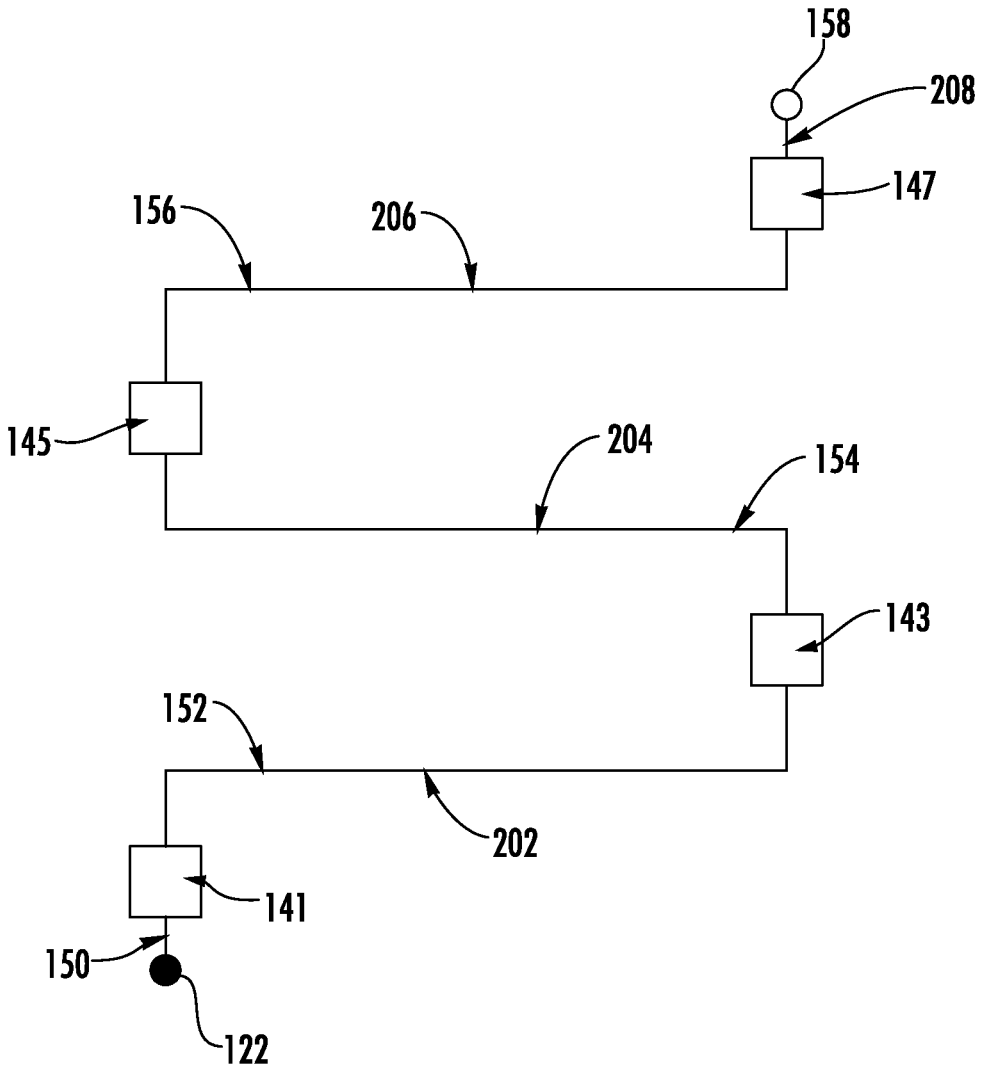
FIG. 9 is a schematic diagram of a fluid flow through the muffler assembly of FIG.

Referring to FIG. 9, a schematic of the fluid flow through the muffler assembly 120 is illustrated. During a first pass 202, the incoming exhaust gases flow from the exhaust conduit 122 into a first chamber 150 and through the first perforated area 141 formed in the baffle assembly 140. As noted above, the first perforated area 141 is positioned toward the front 112 and proximate the right side 118 of the housing 132 (FIG. 7). The gases enter the second chamber 152 through the first perforated area 141 and move toward the second perforated area 143 positioned at the opposite end of the second chamber 152 (e.g., toward the back 114 of the muffler assembly 120).

Next, the gases flow through the second perforated area 143 in a second pass 204. The gases move into the third chamber 154 (e.g., stepped chamber 154) and back toward the front 112 of the muffler assembly 120 and toward the third perforated area 145 (FIG. 8). As such, the gases moving through the third chamber 154 (e.g., from proximate the rear of the housing 132 to the front 112) are substantially opposite in direction to the gases moving through the second chamber 152 (e.g., from proximate the front 112 of the housing 132 to the rear 114).

The gases then flow through the third perforated area 145 in a third pass 206. The gases move into the fourth chamber 156 and toward the left side of the housing 132 to the fourth perforated area 147 (FIG. 7). Accordingly, the gases moving in the fourth chamber 156 (e.g., from proximate the right side 118 of the housing 132 to the left side 116) are substantially perpendicular in direction to the gases moving through the third chamber 154 (e.g., from proximate the rear of the housing 132 to the front 112).

Finally, the gases flow through the fourth perforated area 147 in a fourth (e.g., final) pass 208. The fourth perforated area 147 (e.g., final perforated area 147) is formed on the outlet tube 148 and the fourth perforations 177 extend between the fourth chamber 156 and the outlet chamber 158. Once the gases move into the outlet chamber 158, the gases are directed toward the end 151 of the outlet tube 148 and are expelled out of the muffler assembly 120. In the outlet chamber 158, the gases move approximately from the rear 114 to the front 112 of the housing (FIG. 7). Accordingly, the gases moving through the outlet chamber 158 are substantially opposite in direction to the gases flowing through the second chamber 152 and are substantially parallel in direction to the gases flowing through the third chamber 154 (FIGS. 7-8). Further, the gases moving through the outlet chamber 158 are substantially perpendicular to the gases moving through the fourth chamber 156 (FIG. 7).

The four noise dampening passes 202, 204, 206, and 208 are arranged in counter flow arrangements to the adjacent noise dampening passes so that the exhaust gases moving through the four passes travels in a first direction in a second chamber 152, is redirected in a second opposite direction in the third chamber 154, takes a substantially perpendicular turn in the fourth chamber 156, and returns to the first direction in the outlet chamber 158. Fluid flow passes are considered to be substantially the same direction when one fluid flow pass falls within plus or minus 25 degrees of the bearing of the referenced fluid flow pass in the same direction of travel. Fluid flow passes are considered to be substantially the opposite direction when one fluid flow pass falls within plus or minus 25 degrees of the bearing of the referenced fluid flow pass in the opposite direction of travel. Fluid flow passes are considered to be substantially perpendicular in direction when one fluid flow pass falls within plus or minus 10 degrees of 90 degrees from the referenced fluid flow pass.

Figure 10:
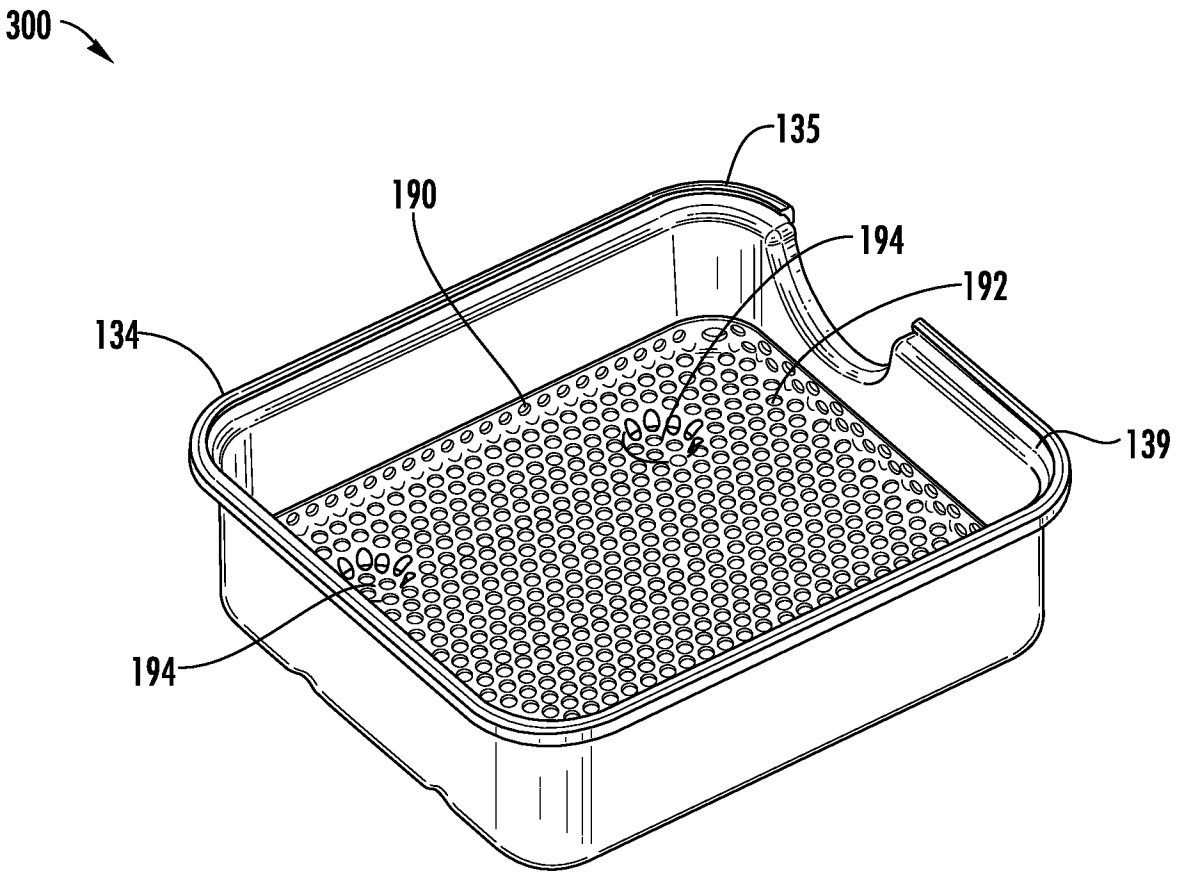
FIG. 10 is a bottom perspective view of a cover of the muffler assembly of FIG. 3.

Referring to FIG. 10, a noise dampening assembly 300 is shown, according to an exemplary embodiment. The noise dampening assembly 300 includes the cover 134 of the muffler assembly 120, a retainer 190, and a noise dampening material 192. The noise dampening material 192 is made from fiberglass. In other embodiments, the noise dampening material 192 may include other materials that act to dampen noise. The noise dampening material 192 is held into place within the cover 134 by the retainer 190. The retainer 190 is made from a metallic material and is perforated to allow sound waves in the fourth chamber 156 to communicate with and be absorbed by the noise dampening material 192. The retainer 190 can be tuned to a certain frequency to allow for further noise attenuation (e.g., by changing the relative size and location of the individual perforations or changing the material of the retainer). The retainer 190 and noise dampening material 192 are attached to the underside of the cover 134 at fastener locations 194. The retainer 190 is spot-welded to the cover 134 to retain the noise dampening material 192 therein. In other embodiments, the retainer 190 is attached to the housing 132 of the muffler assembly 120 using other means of attachment (e.g., bolted).

In an exemplary embodiment, the noise dampening assembly 300 is positioned within the cover 134 of the housing 132 and as such, is positioned within the fourth chamber 156 to provide noise dampening within the muffler assembly 120. As fluid flows through the third perforated area 145 and into the fourth chamber 156, the noise from the fluid will be absorbed by the noise dampening assembly 300 as the fluid passes through the fourth chamber 156. In addition to noise reduction, the noise dampening assembly 300 may also provide temperature reduction on the outer surface of the housing 132 due to the separation of relatively hot exhaust gases from the top surface of the housing 132. In other embodiments, in addition, a similar noise dampening assembly may also be included in the base 136 of the housing 132.

The dimensions and placement of the chambers, perforations, and other components described herein are configured to facilitate the dampening of noise through the muffler assembly 120. Specifically, the perforations formed in the baffle assembly 140 are positioned such that the length of the flow path through the muffler assembly 120 is as long as possible. Using the lengthened flow path created within the baffle assembly 140 and the multiple turns of the fluid flow path, the noise attenuation through the muffler assembly 120 is facilitated. As the exhaust gases move through the muffler assembly 120, the exhaust noise is dampened, and the longer the flow path or more surfaces that the exhaust gases come into contact with while moving through the muffler assembly 120, the more noise attenuation occurs.

Furthermore, the use of four passes of sound filtering results in an additional pass as compared with most conventional mufflers (e.g., three pass mufflers). The additional pass creates an additional point of noise dampening. In addition, the use of a stepped chamber portion 146 with a stepped portion 161 creates a more torturous path for the fluid flow through the muffler assembly 120 and allows room for the fluid flow to develop after flowing through the perforations (e.g., second set perforated area 143). Thus, the stepped chamber portion 146 also acts to improve the attenuation of noise through the muffler assembly 120.

As described herein, the muffler assembly can result in up to 3 decibels (dB) less of noise generation as compared to a conventional muffler. Specifically, in tests run by the Applicant, the noise generated by a conventional muffler was compared to the noise generated from the muffler described herein. The comparison of noise generation from the conventional to the described muffler showed a decrease from approximately 100 dB to 97.5 dB, resulting in a 2.5 dB drop in noise production.

The construction and arrangement of the apparatus, systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, some elements shown as integrally formed may be constructed from multiple parts or elements, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

As utilized herein, the terms "approximately," "about," "substantially," and similar terms are intended to have a broad meaning in harmony with the common and accepted usage by those of ordinary skill in the art of outdoor power equipment. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and are considered to be within the scope of the disclosure.

What is claimed is:

1. An internal combustion engine, comprising:

an engine block including a cylinder; and a muffler assembly configured to receive exhaust gases from the cylinder, the muffler assembly comprising:

a housing defining an interior volume and including an exhaust inlet and an exhaust outlet; and a baffle assembly positioned within the interior volume, the baffle assembly comprising a plurality of chambers in fluid communication with each other;

wherein the plurality of chambers comprise a first chamber, a second chamber, a third chamber, a fourth chamber, and an outlet chamber;

wherein the plurality of chambers are in fluid communication with the exhaust inlet and the exhaust outlet so that the plurality of chambers are configured to cause the exhaust gases to be directed through the muffler assembly from the exhaust inlet to the exhaust outlet through four passes in the baffle assembly before exiting through the exhaust outlet;

wherein the first chamber is in direct fluid communication with the second chamber so that the first chamber and second chamber are configured to cause the exhaust gases to flow into the first chamber and the second chamber from the exhaust inlet to complete a first pass;

wherein the third chamber is in direct fluid communication with the second chamber so that the second chamber and the third chamber are configured to cause the exhaust gases to flow into the third chamber from the second chamber to complete a second pass, wherein the second pass is in an opposite direction from the first pass;

wherein the fourth chamber is in direct fluid communication with the third chamber so that the third chamber and the fourth chamber are configured to cause the exhaust gases to flow into the fourth chamber from the third chamber to complete a third pass, wherein the third pass is in a substantially perpendicular direction from the second pass; and wherein the outlet chamber is in direct fluid communication with the fourth chamber so that the fourth chamber and outlet chamber are configured to cause the exhaust gases to flow into the outlet chamber from the fourth chamber to complete a fourth pass, wherein the fourth pass is in a substantially perpendicular direction from the third pass and is in the same direction as the second pass.

2. The engine of claim 1, wherein the baffle assembly further comprises a plurality of perforated areas including a first perforated area, a second perforated area, a third perforated area, and a fourth perforated area.

3. The engine of claim 2, wherein the first chamber is in direct fluid communication with the second chamber via the first perforated area so that the first and second chambers are configured to cause the exhaust gases to flow through the first perforated area into the second chamber from the first chamber to complete the first pass;

wherein the second chamber is in direct fluid communication with the third chamber via the second perforated area so that the second and third chambers are configured to cause the exhaust gases to flow through the second perforated area into the third chamber from the second chamber to complete the second pass;

wherein the third chamber is in direct fluid communication with the fourth chamber via the third perforated area so that the third and fourth chambers are configured to cause the exhaust gases to flow through the third perforated area into the fourth chamber from the third chamber to complete the third pass;

wherein the fourth chamber is in direct fluid communication with the outlet chamber via the fourth perforated area so that the fourth and outlet chambers are configured to cause the exhaust gases to flow through the fourth perforated area into the outlet chamber from the fourth chamber to complete the fourth pass.

4. The engine of claim 2, wherein the third chamber includes the second set of perforations and the third set of perforations and is formed partially by a stepped chamber portion;

wherein a surface of the stepped chamber portion does not include perforations;

wherein the second set of perforations are positioned directly below the stepped chamber portion.

5. The engine of claim 2, wherein the first perforated area is positioned opposite from the second perforated area within the second chamber;

wherein the second perforated area is positioned opposite from the third perforated area within the third chamber;

wherein the third perforated area is positioned opposite from the fourth perforated area within the fourth chamber;

wherein the fourth perforated area is positioned opposite from the exhaust outlet within the outlet chamber.

6. The engine of claim 2, wherein the outlet chamber is formed by an outlet tube that is tubular in shape;

wherein the fourth set of perforations are formed on a curved surface of the outlet tube.

7. The engine of claim 1, further comprising a noise dampening material retained within a cover.

8. A muffler assembly configured to dampen noise of exhaust gases flowing therethrough, the muffler assembly comprising:

a housing defining an interior volume and including an exhaust inlet and an exhaust outlet; and a baffle assembly positioned within the interior volume, the baffle assembly comprising a plurality of chambers in fluid communication with each other;

wherein the plurality of chambers comprise a first chamber, a second chamber, a third chamber, a fourth chamber, and an outlet chamber;

wherein the plurality of chambers are in fluid communication with the exhaust inlet and the exhaust outlet so that the plurality of chambers are configured to cause the exhaust gases to be directed through the muffler assembly from the exhaust inlet to the exhaust outlet through four passes in the baffle assembly before exiting through the exhaust outlet;

wherein the first chamber is in direct fluid communication with the second chamber so that the first chamber and the second chamber are configured to cause the exhaust gases to flow into the first chamber and the second chamber from the exhaust inlet to complete a first pass;

wherein the third chamber is in direct fluid communication with the second chamber so that the second chamber and the third chamber are configured to cause the exhaust gases to flow into the third chamber from the second chamber to complete a second pass, wherein the second pass is in an opposite direction from the first pass;

wherein the fourth chamber is in direct fluid communication with the third chamber so that the third chamber and the fourth chamber are configured to cause the exhaust gases to flow into the fourth chamber from the third chamber to complete a third pass, wherein the third pass is in a substantially perpendicular direction from the second pass;

wherein the outlet chamber is in direct fluid communication with the fourth chamber so that the fourth chamber and the outlet chamber are configured to cause the exhaust gases to flow into the outlet chamber from the fourth chamber to complete a fourth pass, wherein the fourth pass is in a substantially perpendicular direction from the third pass and is the same direction as the second pass.

9. The muffler assembly of claim 8, wherein the baffle assembly further comprises a plurality of perforated areas including a first perforated area, a second perforated area, a third perforated area, and a fourth perforated area.

10. The muffler assembly of claim 9, wherein the first chamber is in direct fluid communication with the second chamber via the first perforated area so that the first and second chambers are configured to cause the exhaust gases to flow through the first perforated area into the second chamber from the first chamber to complete the first pass;

wherein the second chamber is in direct fluid communication with the third chamber via the second perforated area so that the second and third chambers are configured to cause the exhaust gases to flow through the second perforated area into the third chamber from the second chamber to complete the second pass;

wherein the third chamber is in direct fluid communication with the fourth chamber via the third perforated area so that the third and fourth chambers are configured to cause the exhaust gases to flow through the third perforated area into the fourth chamber from the third chamber to complete the third pass;

wherein the fourth chamber is in direct fluid communication with the outlet chamber via the fourth perforated area so that the fourth and outlet chambers are configured to cause the exhaust gases to flow through the fourth perforated area into the outlet chamber from the fourth chamber to complete the fourth pass.

11. The muffler assembly of claim 9, wherein the third chamber includes the second perforated area and the third perforated area and is formed partially by a stepped chamber portion;

wherein a surface of the stepped chamber portion does not include a perforated area;

wherein the second perforated area is positioned directly below the stepped chamber portion.

12. The muffler assembly of claim 9, wherein the first perforated area is positioned opposite from the second perforated area within the second chamber;

wherein the second perforated area is positioned opposite from the third perforated area within the third chamber;

wherein the third perforated area is positioned opposite from the fourth perforated area within the fourth chamber;

wherein the fourth perforated area is positioned opposite from the exhaust outlet within the outlet chamber.

13. The muffler assembly of claim 9, wherein the outlet chamber is formed by an outlet tube that is tubular in shape;

wherein the fourth perforated area includes a fourth set of perforations formed on a curved surface of the outlet tube.

14. The muffler assembly of claim 8, further comprising a noise dampening material retained within a cover.

* * * * *